United States Patent [19]

Valantin

[11] 4,255,068

[45] Mar. 10, 1981

[54] METHOD AND A DEVICE FOR UNDERSEA DRILLING

[75] Inventor: Alfred Valantin, Clermont, France

[73] Assignee: Techniques Industrielles et Minieres, Paris, France; a part interest

[21] Appl. No.: 52,237

[22] Filed: Jun. 26, 1979

[30] Foreign Application Priority Data

Jul. 4, 1978 [FR] France ..... 78 19897

[51] Int. Cl.[3] ..... E21B 7/12

[52] U.S. Cl. ..... 405/195; 175/6; 175/86; 175/171; 405/185

[58] Field of Search ..... 405/195, 196, 185, 207; 175/6, 9, 171, 86; 299/8

[56] References Cited

U.S. PATENT DOCUMENTS

| | | | |
|---|---|---|---|
| 687,830 | 12/1901 | Kirk | 299/8 |
| 987,266 | 3/1911 | Smith | 405/196 X |
| 2,171,672 | 9/1939 | Plummer | 405/207 |
| 2,937,006 | 5/1960 | Thayer | 175/6 |
| 3,095,048 | 6/1963 | O'Neill et al. | 175/6 |
| 3,661,204 | 5/1972 | Blanding et al. | 175/6 X |

FOREIGN PATENT DOCUMENTS 330433 6/1930 United Kingdom .

*Primary Examiner*—Dennis L. Taylor
*Attorney, Agent, or Firm*—Young & Thompson

[57] ABSTRACT

The method consists in boring a shaft in the sea floor to form a drilling station of sufficient size to accommodate personnel and equipment, in lining the shaft walls with a casing which is cemented against the walls and surmounted by a water-tight self-contained subsea chamber, in extracting sea water from the shaft, in maintaining atmospheric pressure within the shaft and the subsea chamber, in lowering personnel and drilling equipment into the shaft and in carrying out drilling operations from the bottom of the shaft.

11 Claims, 7 Drawing Figures

METHOD AND A DEVICE FOR UNDERSEA DRILLING

This invention relates to a method of drilling of ocean bottom formations for exploratory boreholes or subsoil exploitation. The invention is further concerned with a device for carrying out said method.

Known methods of this type call for positioning or erection of a drilling station which can be either a ship anchored with precision or a platform which rests on the sea floor if this is permitted by the water depth. A drawback which is common to all these methods lies in the difficulty involved in ensuring a permanent and accurate link between the drilling means proper and the station, especially if the water is relatively rough.

Furthermore, it often happens that certain completion operations such as positioning or connecting a well-head assembly require the intervention of divers or of personnel working in diving bells, with all the disadvantages attached to these methods of operation.

The aim of this invention is to provide a method for carrying out underwater drilling operations without any of the limitations mentioned above.

According to a first aspect of the invention, the method of underwater drilling for exploring and exploiting ocean bottom formations involves the erection of a drilling station directly above the selected site followed by the drilling operation carried out from said station. The method essentially comprises the operations which consist:

(a) in boring a sea-floor shaft in order to form a drilling and exploitation station having sufficient dimensions to contain personnel and drilling equipment, this operation being performed by means of a shaft-boring module which rests on the bottom, (b) in lining the walls of the shaft with a casing which is cemented against said shaft walls and is surmounted by a water-tight self-contained subsea chamber, (c) in extracting sea-water from the shaft, (d) in maintaining atmospheric pressure within the shaft and within the subsea chamber, (e) in lowering personnel and drilling equipment into the shaft, (f) in carrying out drilling operations from the bottom of the shaft.

Neither the installation for boring the shaft nor the drilling station which has been placed in position are linked with a surface vessel at any moment otherwise than by temporary cable connections which serve as guiding means for lowering equipment. Furthermore, since the shaft is bored in the sea bottom formation, no structure of the derrick type is employed. The method can therefore be carried out at any depth and under any weather conditions. Finally, the fact that atmospheric pressure is maintained within the work stations avoids any need to subject personnel to decompression periods.

In a preferred embodiment of the method, atmospheric pressure is maintained within the shaft and the subsea chamber by connecting the chamber to a gallery which has been laid on the sea bed and communicates with the open air at one point of the shore.

A gallery of this type can also be employed for supplying drilling equipment, for transporting personnel and subsequently for the management of drilling operations.

Provided that geological conditions prove favorable, the invention advantageously contemplates the possibility of continuing the shaft-boring operation until an impermeable subsoil stratum is reached in order to reduce infiltrations of water into the shaft.

According to a second aspect of the invention, the underwater drilling device for exploring and exploiting bottom formations and especially for applying a method as described in the foregoing comprises a shaft-boring module forming a water-tight enclosure and provided with means for communicating with the open air. Said module comprises shaft-boring means fixed on a downwardly displaceable extension which is adapted to project from the module through a seal, and operating means for downwardly displacing the shaft-boring means and applying said means against the bottom. The device is distinguished by the fact that the shaft-boring means comprise an extensible boring head which is locked rotationally with respect to the module, said boring head being provided with axial actuating means and adapted to pass out of said module through first sealing means. The shaft-boring means further comprise a shaft-boring arm carrier which is attached to the lower end of said boring head through the intermediary of actuating means for driving said arm carrier in rotation and which cooperates with said boring head through the intermediary of second sealing means.

This dissociation of the two movements and of the respective sealing means not only offers an evident technological advantage but also makes it possible to mount the rotary actuating means in an end position and to ensure that no water is present within the tube which forms an extension of the boring head.

According to a preferred feature of the invention, the axial actuating means of the boring head comprise clamping means for alternately coupling the boring head with the module and with a system of jacks.

The arm carrier advantageously comprises rotary arms which are articulated so as to be capable of folding-back parallel to the axis of rotation and so as to provide in the outwardly extended position a boring diameter which is greater than the diameter of the boring head in order to permit ready withdrawal of the assembly into the module.

Preferably, the shaft-boring module further comprises a pump, the suction side of which is connected to an extensible pipe which opens into the bottom of the shaft during a boring operation for the removal of cuttings.

In an advantageous embodiment of the invention, the boring module is integral with at least one module for assembling and laying a gallery which is placed on the sea bed, said gallery being intended to communicate with the open air at one point of the shore, the atmospheres of the two modules being in communication with each other.

The gallery-laying module accordingly serves as a means of locomotion for the first access to the drilling site while at the same time installing the gallery which provides a connection with the open air on land.

Further distinctive features and advantages of the invention will be brought out by the following detailed description, reference being made to the accompanying drawings which are given by way of example without any limitation being implied, and in which.

Figure 1:
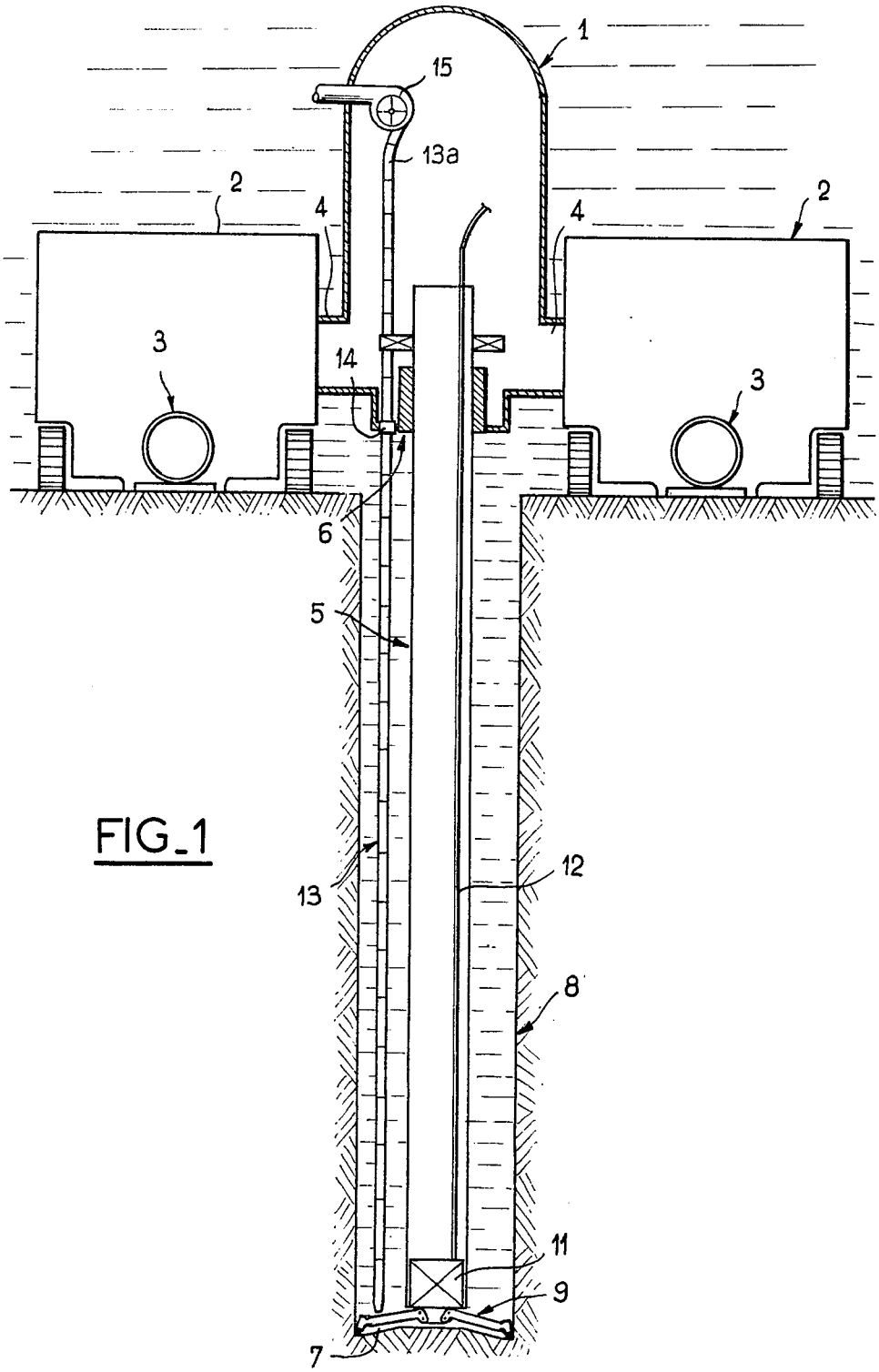
FIG. 1 is a general view of the device showing the shaft-boring module and its ancillary components.

Referring first to FIG. 1, the device comprises a shaft-boring module 1 connected to two twin underwater vehicles 2 (or erecting modules) which are designed for self-propulsion along the sea floor, each vehicle being intended to erect and lay one underwater gallery 3 as it advances. Vehicles of this type are described in French patent Application No 78 19467 in the name of the present Applicants.

The shaft-boring module 1 communicates with the underwater vehicles 2 by means of connecting ducts 4 which are of sufficient size to supply the boring equipment from the shore via the galleries 3. The ventilation air follows the same path.

In the operating position shown in FIG. 1, the module 1 comprises a tube 5 which extends downwards from the module proper through a water-tight passage 6 in order to carry out the boring operation by applying a boring head 9 against the bottom 7 of a shaft 8. Said boring head is driven by a reduction-gear motor set 11 supplied through an electric cable 12 which is housed within the interior of the tube 5.

The lower end of a pipe 13 has its opening in the vicinity of the bottom 7 of the shaft 8 and extends into the module 1 through a water-tight passage 14, the upper end of said pipe being connected by means of a flexible connecting tube 13*a* to a pump 15, the discharge side of which communicates with the sea.

The shaft-boring module 1 will now be described with reference to FIG. 2 in which said module is shown in the rest position, for example during the site approach stage.

The boring head 9 is mounted in a table 16 with which said head can be coupled by means of an elastic ring 17 fitted within a channel 18 of the table 16 and forming a circular chamber 19 which can be put into communication through a duct 21 with a source of hydraulic fluid (not shown in the drawings). It is apparent that, under the action of the hydraulic pressure, the ring 17 exerts a powerful clamping action on the boring head 9 and couples this latter with the table 16.

The table 16 is in turn attached to the operating rods 22 of two vertical jacks 23 which serve to displace the boring head 9 in the axial direction. The table 16 is adapted to cooperate with the pipe 13 in the same manner by means of an elastic ring 24 which is of the same type as the ring 17 and is attached to the duct 21.

The boring head 9 is engaged within a lock-chamber 25 and penetrates into this latter through a water-tight passage 26. Said boring head can be coupled axially with the lock-chamber by means of a ring 27 which is similar to those hereinabove described and to which a hydraulic pressure can be applied through a pipe 28. Similarly, the pipe 13 can be tightly surrounded in the vicinity of the water-tight passage 19 by a ring 29 which is rigidly fixed to the frame of the module 1.

The lock-chamber 25 is provided with an outlet gate 31 which can be actuated by a jack 32 and with an inspection door 33.

Figure 3:
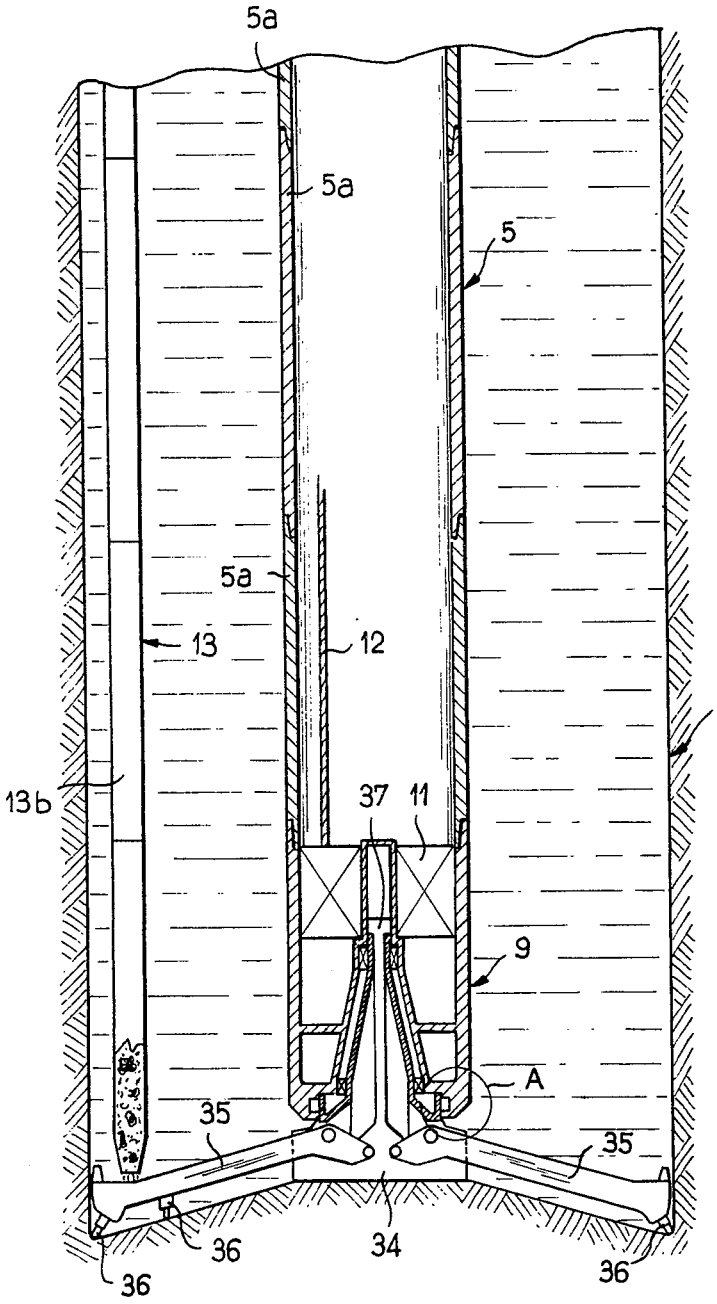
FIG. 3 is a detail view of the shaft-boring unit which has reached the work position at the bottom of the shaft after a downward movement of withdrawal from the module.

The reduction-gear motor set 11 of the boring head 9 serves to actuate a rotating system comprising an arm carrier 34 to which are pivotally attached two tool-holder arms 35 on which are mounted cutting tools 36 (as shown in FIG. 3), only a few tools being shown in the figure. A hydraulic piston 37 serves to separate the arms 35 when the boring head 9 has moved away from the module.

Figure 4:
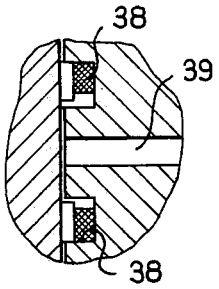
FIG. 4 is an enlarged detail view of portion A of FIG. 3.

The rotating system is adapted to cooperate with the stationary portion of the boring head 9 by means of a double-packing gland-seal 38 into which oil is injected through a duct 39 (as shown in FIG. 4).

Figure 2:
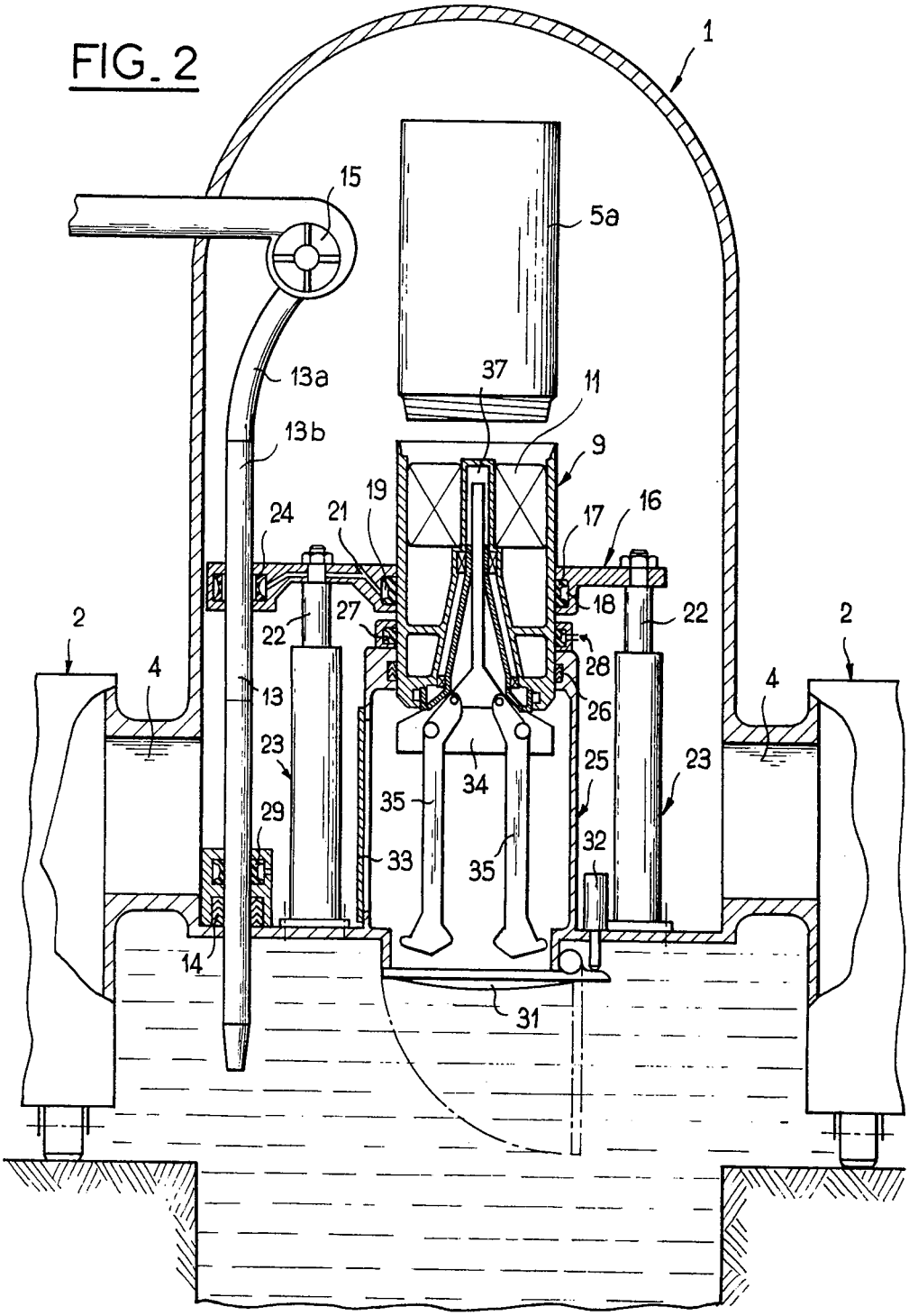
FIG. 2 is a view to a larger scale showing the shaft-boring module in the folded-back position.

When the shaft-boring module 1 carried by the underwater vehicles 2 has come into position directly above the selected site, the gate 31 of the lock-chamber 25 is opened and the boring head 9 is lowered at the same time as the pipe 13 through the respective water-tight passages 26 and 14 (shown in FIG. 2). To this end, the rings 17 and 24 are locked in position by injection of hydraulic fluid and the rings 27 and 29 are released, whereupon the table 16 is moved downwards by means of the jacks 23.

Once the jacks 23 have reached the end of travel, the locking action of the aforementioned rings is reversed and the table 16 is returned upwards. After a further reversal of the locking action of the rings, the procedure is repeated.

When the boring head 9 has been moved away from the lock-chamber 25 to a sufficient extent, the tool-holder arms 35 are separated by displacing the piston 37 to the position shown FIG. 3 and the boring operation is then begun. Cuttings are discharged into the sea by means of the pipe 13 and the pump 15.

When the upper portion of the boring head 9 reaches the level of the table 16, a tubular element 5*a* having the same diameter is screwed onto said head and serves as an extension of this latter. The same procedure is adopted in the case of the pipe 13 which is accordingly extended by elements 13*b*. During the boring operation, the head 9 is therefore located at the end of a tube 5 which is formed by the elements 5*a* and through which extends the electric cable 12 for supplying current to the reduction-gear motor set 11.

The boring operation is facilitated by the vertical force exerted by the table 16 on the tube 5, said table being also intended to prevent rotation of the tube 5.

The dimensions of the shaft are such as to accommodate both personnel and drilling equipment after they have been lowered into the shaft in a subsequent stage. By way of example, the diameter can be four meters. On the other hand, the depth of the shaft is preferably such that the bottom of this latter is located within an impermeable layer which will limit subsequent infiltrations. A maximum depth of the order of one hundred meters may thus be reached.

Figure 5:
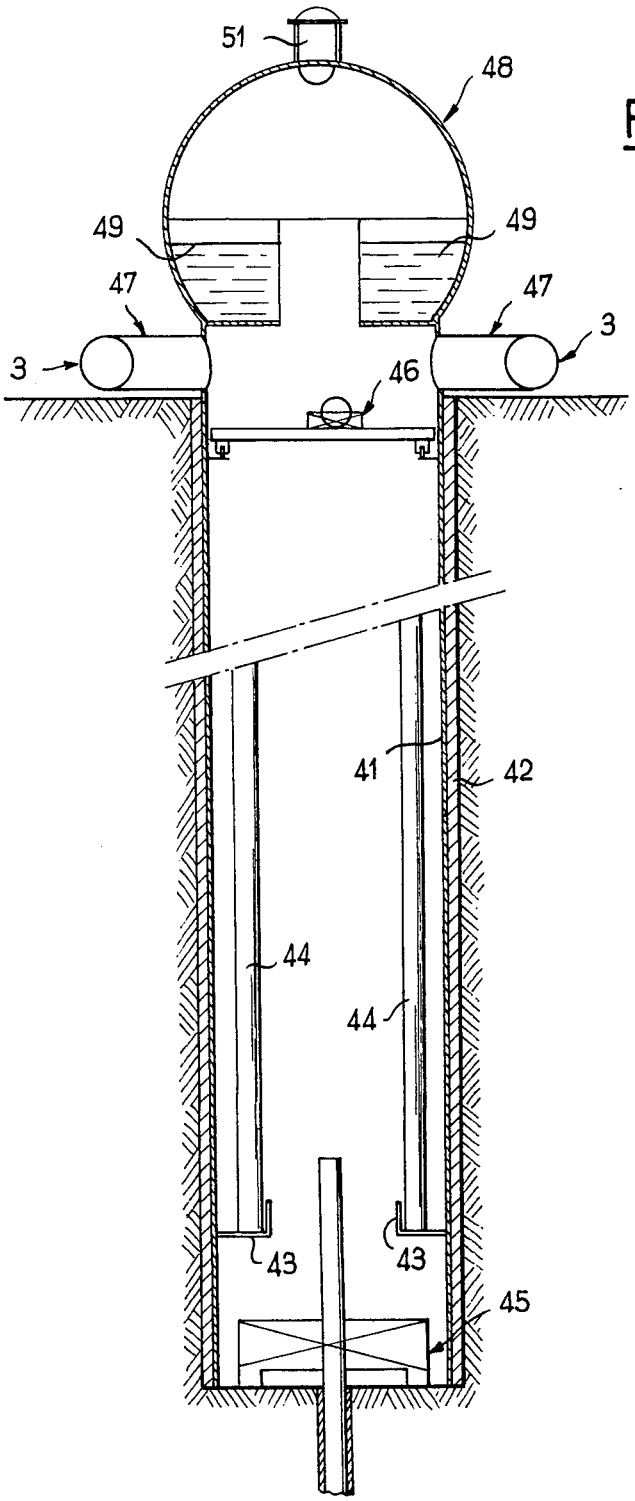
FIG. 5 is a general view of the shaft after positioning of the casing and of the subsea chamber.

Once the boring operation has been completed, the boring head is returned upwards by carrying out reverse operations and the shaft-boring module is displaced in order to free the entrance of the shaft. There is then lowered into the shaft a casing surmounted by a subsea chamber which is lowered from a support ship. This assembly will now be described with reference to FIG. 5 in which it is shown in the final installed position.

The casing is mainly composed of a tube 41 which may be a metal tube, for example, and formed of a plurality of sections assembled together at the time of erection. This tube is attached to the wall of the shaft which has just been bored by means of a layer 42 of underwater-setting cement which is injected at the time of laying by means of a known method such as an injection lance, for example.

The tube 41 is provided with support brackets 43 to which are secured especially the drill rods together with all the ancillary drilling equipment which has been shown diagrammatically at 45 in the operating position.

Provision is made at the upper end of the tube 41 for a traveling bride crane 46 for handling and positioning the drilling equipment.

Above the level of the sea bed, two communication ducts 47 extend from the tube 41 and are joined respectively to the galleries 3 laid by the underwater vehicles 2.

A dome 48 which is fixed in water-tight manner at the top of the tube 41 constitutes a subsea chamber for personnel and also comprises storage tanks 49 which contain drilling water. At the top of said subsea chamber, there is provided a lock-chamber 51 for personnel and also for the supply of certain types of equipment if necessary.

Figure 6:
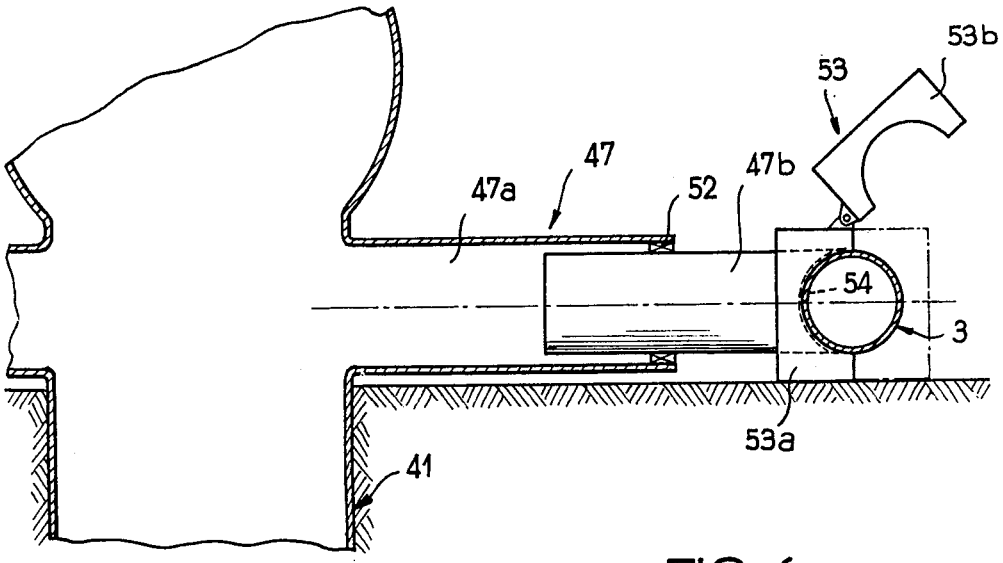
FIG. 6 is a view showing the junction operation in which the subsea chamber is connected to an underwater gallery.

When the tube 41 has been placed in position and fixed by injection of the cement layer 42, the water contained in the tube is extracted from this latter and at least part of the personnel is lowered through the lock-chamber 51 in order to carry out the initial operations which consist especially in connecting-up with the galleries 3. In order to establish this connection, each communication duct 47 comprises a tube **47*a* which is integral with the casing and a tube 47*b* which slides within the tube just mentioned via a water-tight passage 52 (as shown in FIG. 6**).

At the free end thereof, the tube **47*b* is adapted to carry a collar 53 composed of a half-collar 53*a* rigidly fixed to the tube 47*b* and a half-collar 53*b* pivotally mounted on 53*a*. The tube 47*b* is closed by a sealing disc 54 which conforms to the cylindrical shape of the half-collar 53*a***.

Once the casing has been placed in position, the tube **47*b* is displaced in sliding motion until the half-collar 53*a* is applied against the gallery 3, whereupon the half-collar 53*b* is downwardly displaced in pivotal motion onto the gallery by means of actuating devices (not shown) which may comprise jacks. O-ring seals ensure water-tight cooperation of the collar 53 with the external wall of the gallery 3**.

The next step consists in destroying the sealing disc 54 and that portion of the gallery 3 which is located opposite, thereby establishing a communication between the subsea chamber 48 and said gallery 3.

Figure 7:
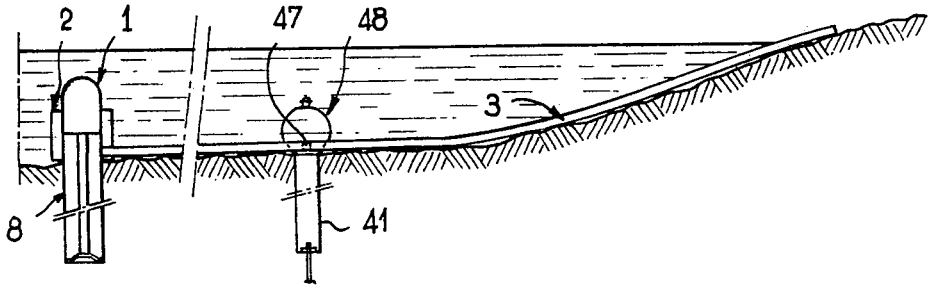
FIG. 7 is a general diagrammatic view to a small scale and showing a drilling installation in accordance with the invention.

The shaft and subsea chamber are then at atmospheric pressure since the gallery 3 is open to free air at one point of the shore (as shown in FIG. 7. Drilling operations are performed under the same conditions as on land and a conventional Christmas tree or flow assembly can readily be placed on top of the borehole. Access can subsequently be gained to the subsea chamber through the galleries 3 and therefore by dry route and the same applies to the removal of materials extracted during drilling operations.

There is shown in FIG. 7 a complete drilling station during operations. A first borehole equipped with a subsea chamber 48 and with a lined shaft 41 have already been completed as shown on the right whereas a shaft-boring operation is being performed by a module 1 as shown on the left. Both work stations are ventilated at atmospheric pressure through the gallery 3 which is open on shore.

The invention therefore makes it possible to carry out underwater drilling operations practically under the same conditions as on land while removing all the disadvantages arising from water depth or state of the sea. Members of personnel work at atmospheric pressure and are not subject to any of the limitations imposed by breathing under pressure, ventilation being carried out as in mining installations on land. Finally, subsequent working or development of the deposit also takes place as on land. Operations can be interrupted and then resumed without any difficulty.

As can readily be understood, the invention is not limited to the example hereinbefore described and a number of different alternative forms could be devised without thereby departing from either the scope or the spirit of the invention. By way of example, it would be possible to employ only one underwater vehicle 2 for laying a single gallery 3 on condition that the assembly constituted by the shaft-boring module and the underwater vehicle is suitably balanced.

What is claimed is:

1. A method of underwater drilling for exploring and exploiting ocean bottom formations comprising the erection of a drilling station directly above the selected site and the drilling operation which is carried out from said station, wherein said method essentially comprises the operations which consist:

(a) in boring a sea-floor shaft in order to form a drilling and exploitation station having sufficient dimensions to contain personnel and drilling equipment, this operation being performed by means of a shaft-boring module which rests on the bottom, (b) in lining the walls of the shaft with a casing which is cemented against said shaft walls and is surmounted by a water-tight self-contained subsea chamber, (c) in extracting sea-water from the shaft, (d) in maintaining atmospheric pressure within the shaft and within the subsea chamber, (e) in lowering personnel and drilling equipment into the shaft, (f) in carrying out drilling operations from the bottom of the shaft.

2. A method according to claim 1, wherein atmospheric pressure is maintained within the shaft and the subsea chamber by connecting said chamber to a gallery which has been laid on the sea bed and communicates with the open air at one point of the shore.

3. A method according to claim 1, wherein the shaft-boring operation is continued until an impermeable subsoil stratum is reached.

4. An underwater drilling device for exploring and exploiting ocean bottom formations comprising a shaft-boring module forming a water-tight enclosure and provided with means for communicating with the open air, said module being provided with shaft-boring means fixed on a downwardly displaceable extension which is adapted to project from the module, and operating means for downwardly displacing the shaft-boring means and applying said means against the bottom, wherein said shaft-boring means comprise an extensible boring head which is locked rotationally with respect to said module, said boring head being provided with axial actuating means and adapted to pass out of said module through first sealing means, and a shaft-boring arm carrier which is attached to the lower end of said boring head through the intermediary of actuating means for driving said arm carrier in rotation and which cooperates with said boring head through the intermediary of second sealing means.

5. A device according to claim 4, wherein the axial actuating means of the boring head comprise clamping means for alternately coupling the boring head with the module and with a system of jacks.

6. A device according to claim 4, wherein the arm carrier comprises rotary arms which are articulated so as to be capable of folding-back in a direction parallel to the axis of rotation and so as to provide in the outwardly extended position a boring diameter which is greater than the diameter of the boring head.

7. A device according to claim 4, wherein said device comprises a pump whose suction side is connected to an extensible pipe which opens into the bottom of the shaft during a boring operation.

8. A device according to claim 4, wherein the shaft-boring module is integral with at least one module for assembling and laying a gallery which is placed on the sea bed, said gallery being intended to communicate with the open air at one point of the shore, the atmospheres of the two modules being in communication with each other.

9. A device according to claim 4, wherein said device comprises means whereby a shaft casing and a subsea chamber placed above said casing are lowered from an auxiliary ship.

10. A device according to claim 4, wherein said device comprises at least one connecting duct between the shaft and at least one gallery which is placed on the sea bed and communicates with the open air at one point of the shore.

11. A device according to claim 9, wherein the subsea chamber comprises a lock-chamber in order that personnel and drilling equipment may be admitted into said subsea chamber from an auxiliary ship.

* * * * *